United States Patent [19]

Kratt

[11] Patent Number: 4,488,501

[45] Date of Patent: Dec. 18, 1984

[54] MOORING DEVICE

[76] Inventor: Henry J. Kratt, 602 S. Erie, Tulsa, Okla. 74112

[21] Appl. No.: 432,982

[22] Filed: Oct. 6, 1982

[51] Int. Cl.[3] ..... B63B 21/00

[52] U.S. Cl. ..... 114/230; 114/370; 405/219

[58] Field of Search ..... 114/230, 219, 266, 264, 114/370; 405/212, 219, 220

[56] References Cited

U.S. PATENT DOCUMENTS

| | | | |
|---|---|---|---|
| 611,636 | 10/1898 | Lake | 114/230 |
| 2,336,140 | 12/1943 | Vogger | 405/219 |
| 2,433,858 | 1/1948 | Maxson | 114/230 |
| 2,715,314 | 8/1955 | Smith | 114/230 |
| 2,963,176 | 12/1960 | Smith | 114/230 |
| 3,430,599 | 3/1969 | Lezak | 114/230 |
| 4,123,912 | 11/1978 | Megdrom | 405/220 |

*Primary Examiner*—Trygve M. Blix
*Assistant Examiner*—Patrick W. Young

[57] ABSTRACT

An adjustable mooring device suitable for attaching a floating facility to a fixed platform, the said device comprising a system of adjustable tubular members connected to each other by rotatable T couplings, the said lower tubular members being permanently attached by a pair of T couplings rotatably mounted on a shaft which is fixably attached to the said platform, the upper legs of the said mooring device having tubular members extending forwardly, each of the said upper legs extending into at least one Y connection, the said Y connection being suitable for connecting to a floating facility; the lower section of the said Y connection being supported at the water surface by a float; the said Y connection being connected by suitable means to the said floating facility.

5 Claims, 5 Drawing Figures

(a)

MOORING DEVICE

The present invention relates to a mooring device comprising means to attach and secure a floating docking facility and other floating platforms and boats to a shoreline or a fixed platform.

There are mooring devices available on the market which are useful for securing floating docks, boats to fixed platforms. These floating docks offer means for boats to be anchored away from structures such as an oil rig. Other types of mooring devices are mounted on wharfs so as to anchor the boat away from the wharfs. The difficulty with these mooring devices is that the mooring device only provides for limited or insufficient movement of the attached floating dock in a vertical direction and in a horizontal direction. This movement is caused by changing tides and the movement of the waves.

These types of structures do not provide for extreme changes in water levels due to tide changes and changes in the lake level.

These mooring devices do not provide for adjusting and positioning the docking facility to prevent damage to boats where the shoreline bottom is rocky and the water levels is subject to change. Other mooring devices which are attached directly to a wharf or other fixed platforms are limited in their abiity to remain in a given position relative to the shoreline or platform.

BACKGROUND OF THE INVENTION

The U.S. Pat. No. 2,715,314 issued Aug. 16, 1955 to B. Smith described a mooring device in combination with a floating wharf useful for receiving boats in or near an oil drilling rig in coastal waters. The mooring device is attached to the side of a drilling rig. If the level of the water in relationship to the drilling rig varies very much, the floating wharf would strike the drilling rig structure. When the level of the water dropped along a shoreline, the floating dock could strike the bottom of the water area. These problems are alleviated by my invention.

Also if the shoreline is rocky and slopping the floating wharf shown in this patent might not remain stable, but could strike on the rocky ledge as the water level recedes from the shore. The structure shown and described in the Smith patent is only suitable for application to a special condition as described in the disclosure and does not show the features disclosed in my invention.

The U.S. Pat. No. 3,430,599 issued Mar. 4, 1969 to Lezak is another example of a mooring device. It consists of two bendable boom members mounted in spaced relationship on a stationary dock. The mooring device extends from the dock. The mooring device has means to attach the said booms to the bow and stearn of a boat. The booms are movable in a vertical and lateral direction either by manual or electrical operation at the dock side. The difficulty with this mooring device is that the structure is such that with changing tides and water levels constant adjusting is necessary. The mooring device does not adjust itself with changing water levels. This problem is alleviated by my invention.

The U.S. Pat. No. 3,195,498 issued July 20, 1965 to R. A. Johns describes another type of boat mooring with means to secure a boat to a dock. This patent shows a boat mooring attached to a dock by means of a flexible tube which bends away from the dock. The tube is flexible due to a spring assembly in the tube. This mooring device is also limited in its application and does not teach the structure or function of my invention.

OBJECT OF THE INVENTION

The main object of this invention is to provide a mooring device for attaching a floating dock and boat to a fixed surface.

Another object of this invention is to provide a mooring device which automatically moves up and down with change in the water level.

Another object of this invention is to provide manual adjustable means for changing the length of the different tubular members to satisfy the condition of different shorelines and bottom surfaces of the water.

Still another object of this invention is to furnish means which will prevent any portion of the floating dock and boat from touching the bottom surface of the water and to prevent extreme lateral movement of the floating dock.

PREFERRED EMBODIMENT

Figure 1:
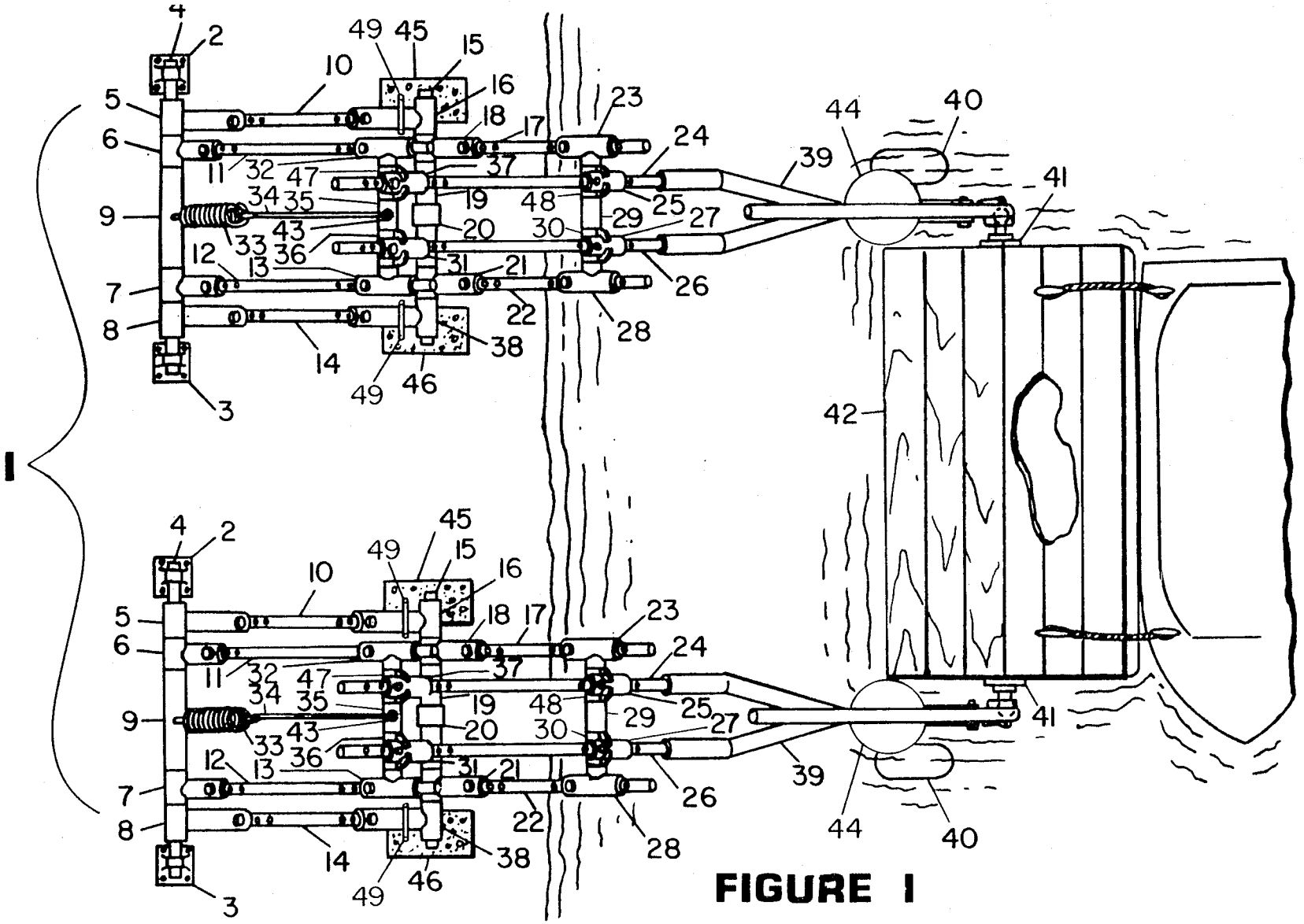
FIG. 1 is a top view of the mooring device attached to a fixed platform and extending over the surface of water to a floating dock.

Reference is made to FIG. 1 which shows a top view of the mooring device 1 which is permanently attached to a fixed surface (not shown) at positions 2 and 3.

The mooring device, shown in FIG. 1, consists of two structurally similar units which are identified using the same number designation since the units are identical in all respects, both extending over the surface of water, both the first and second units being connected to a floating dock and boat 42 at positions 41, concrete pads 45 and 46 are shown as resting places for the forward end of the mooring device 1 when the mooring device 1 is in its lowered position. The base of the mooring device 1 comprises shafts 4 shown in both units which are secured and mounted on blocks at positions 2 and 3, respectively. Rotatably mounted on shaft 4 are T couplings 5, 6, 7 and 8; centered on shaft 4 is tubular member 9 useful as a spacer and to secure spring 33. Attached to spring 33 is cable 34. The cable 34 extends to connection 43 mounted on shaft member 35. Tubular member 10 is supported by adjustable T couplings 5 and 16. Tubular member 14 is supported by adjustable T couplings 8 and 38. Tubular member 11 in the first and second units extend from T coupling 6 to T coupling 32. Tubular member 12 in the first and second units extend from T coupling 7 to T coupling 13. Tubular member 17 in both units extends from T coupling 18 to T coupling 23. Tubular member 22 extends from T coupling 21 to T coupling 28. Tubular member 24 extends from T coupling 37 to T coupling 25. Tubular member 26 in both units extends from T coupling 27 to T coupling 31. Tubular member 17 extends from T coupling 18 to T coupling 23. Tubular member 22 in both units extends from T coupling 21 to T coupling 28. Members 24 and 26 in both units are extended through T couplings 25 and 27 respectively and connect to Y 39. Y 39 is connected to the floating facility 42 at swivels 41. T couplings 16, 18, 19, 31 and 38 in both units are rotatably mounted on shaft 15. Pads 45 and 46 in units 1 and 2 furnish a resting place for the mooring device 1 when in a lowered position. Tubular member 20 in units 1 and 2 act as a counterweight on shaft 15.

Figure 2:
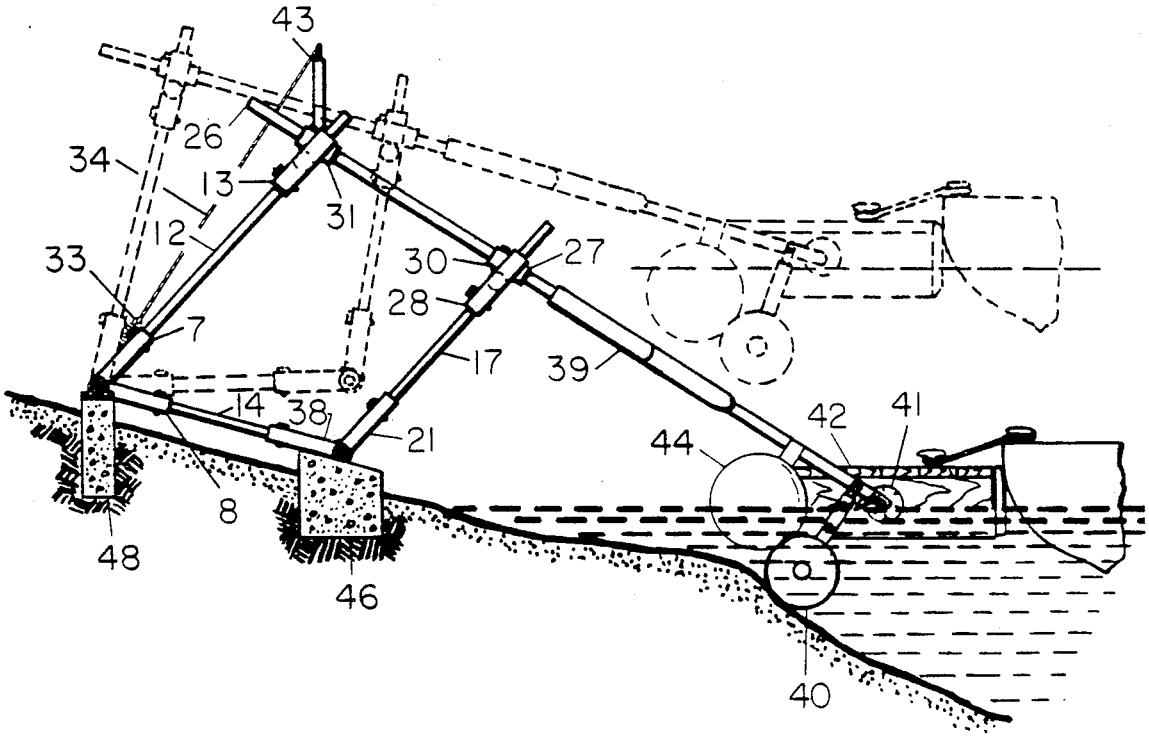
FIG. 2 is a side view of the mooring device in a raised position attached to a fixed surface and extending over water to a floating dock.

Reference is made to FIG. 2 which shows a side view of the mooring device 1, FIG. 1, in a lower position and in a slightly raised position. Both of the units which comprise the mooring device in FIG. 1 are identical, therefore, this side view illustrates either unit of the mooring device 1, FIG. 1. The mooring device FIG. 1, is shown attached to the fixed surface by concrete pads 3. The bottom tubular member 14 extends from T coupling 8 to T coupling 38. Tubular member 12 extends from T coupling 7 to T coupling 13. Both T couplings 7 and 8 are rotatably mounted on shaft 4 (see FIG. 1). T coupling 38 is rotatably mounted on shaft 15 (see FIG. 1). T coupling 13 is rotatably mounted on shaft 35 (see FIG. 1). Tubular member 17 extends from T coupling 21 to T coupling 28 which is mounted on shaft 29 (see FIG. 1). Tubular member 26 is extended to Y 39 (see FIG. 1) which connects to swivel 41 mounted on floating dock facility 42. Attached to Y 39 is a guide wheel 40 to keep the floating dock facility 42 from striking the bottom of the body of water. Also attached to Y 39 is a float 44 to balance the floation of the mooring device 1, FIG. 1.

Figure 3:
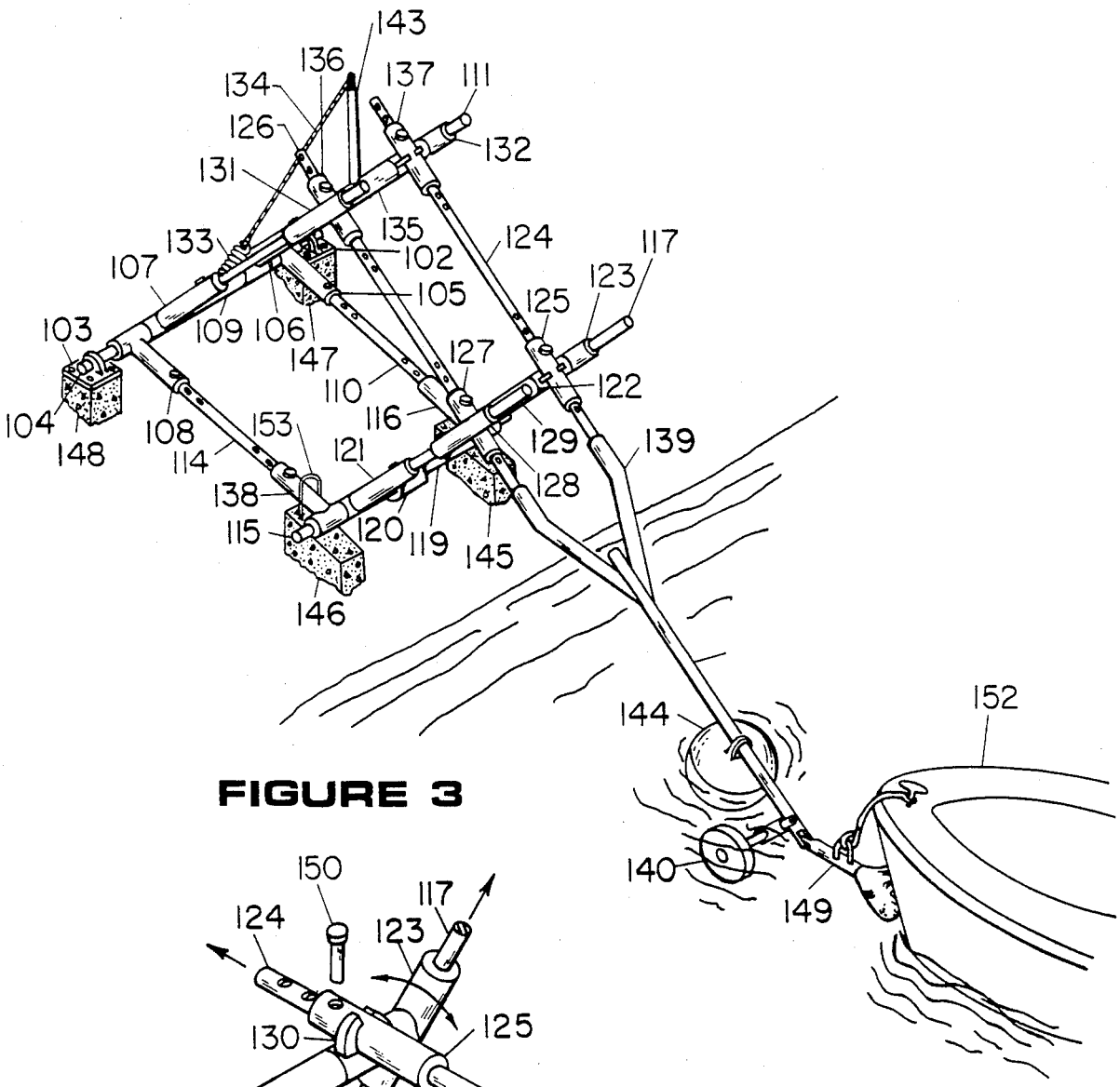
FIG. 3 is an isometric view of the mooring device suitable for securing a single boat to a fixed surface.

Reference is made to FIG. 3 which shows an application of the mooring device 1, FIG. 1, using a single unit for mooring a boat. Concrete pads 102 and 148 are shown with shaft 104 in mounting clamps 103 attached thereto. T couplings 108 and 105, 107 and 106 are rotatably mounted on shaft 104.

Tubular member 114 extends between T couplings 108 and 138. T couplings 138, 121, 118 (see FIG. 1) and 116 are rotatably mounted on shaft 115, a counterweight on the shaft is shown as 120. Tubular member 122 extends between T couplings 121 and 128. Tubular member 117 extends between T couplings 118 (see FIG. 1) and 123. Tubular member 126 extends between T couplings 136 and 127. Tubular member 124 extends between T couplings 137 and 125. Tubular member 148 extends between T couplings 131 and 107. Tubular members 124 and 126 both extend and connect to Y 139, Y 139 connects to boat hitch 149; partial view of the boat 152 is shown tied to hitch 149. Float 144 and bottom wheel 140 are attached to the lower section of Y 139. A limiter is shown as 153 to control the rise of shaft 115. The limiter 153 limits the upward travel of shaft 115.

Figure 4:
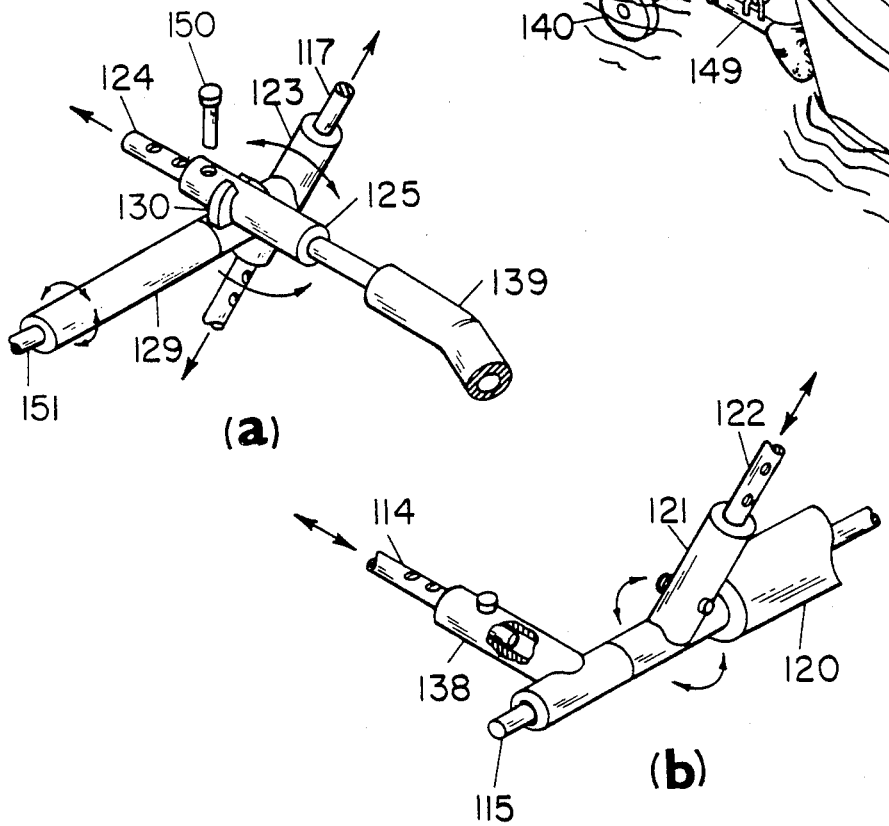
FIG. 4 are details showing the position and movement of rotatable T connections in a mooring device.

FIG. 4(*a*) shows details of connections in assembly of the cross members 117, 124 and 151. Spacer around shaft 151 is shown as 129. T couplings are shown as 123 and 125. Spacer around shaft 151 is shown as 129. T couplings are shown as 123 and 125. A clamp is shown as 130 for holding connection 125. The connection 125 and clamp 130 act as a T coupling for tubular member 124. Tubular member 124 is shown as being adjustable with bolt 150 useful for holding the tubular members in place.

FIG. 4(*b*) is another detail showing the relationship of the rotatable T couplings 121 and 138. Counterweight 120 and T couplings 121 and 138 are mounted on shaft 115. Adjustable tubular member 114 is shown inserted in T coupling 138 and tubular member 122 is inserted into T coupling 121.

Figure 5:
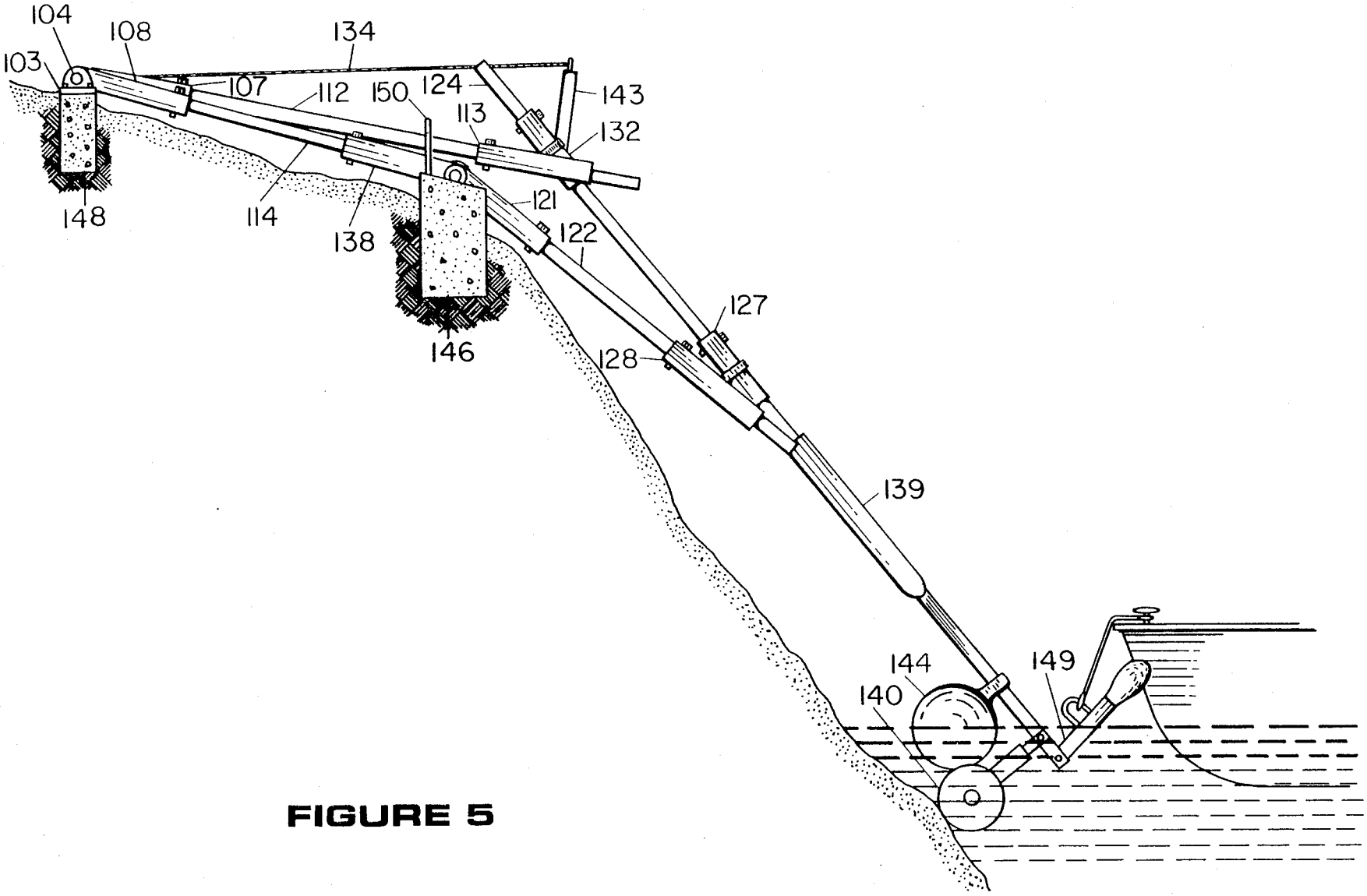
FIG. 5 is a side view of a mooring device showing the mooring device, shown in FIG. 3, in a downward position on a steep inclining lake bottom.

Reference is made to FIG. 5 which is a side view of the mooring device shown in FIG. 3. The mooring device is shown in a downward position when the surface of the water is far below the fixed surface on which the mooring device is attached. The mooring device is shown as being secured at position 103 to concrete piling 148. T couplings 108 and 107 are rotatably mounted on shaft 104. Tubular members 114 extends between T couplings 108 and 138. Tubular member 112 extends between T couplings 108 and 113. Tubular members 124 extends between T couplings 132 and 127. Tubular member 122 extends between T couplings 121 and 128. Tubular members 122 and 124 are extended to Y 139. Y 139 connects to boat support member 149. Float 144 and bottom wheel 140 are mounted on the bottom end of Y 139. Cable 134 extends from spring 133 to 143 (see FIG. 3). Boat hitch located on the lower end of Y 139 is shown as 149.

All tubular members in this mooring device are adjustable in length by adjusting the tubular members in the T couplings.

All T couplings in the assembly rotate on the shaft.

OPERATION

The mooring device is used to keep a floating facility stable in water where the level of the water rises and lowers in lake areas and in areas where there is a tide change.

The mooring device shown herein is equipped to ride on the surface of the water. A bottom wheel 140, FIG. 3, is attached to prevent the floating facility 42, FIG. 1, from striking the rocky lake bottom or sandy ledges which are present in lakes ad shorelines.

The mooring device is structured to control the movement of the floating facility by the vertical and horizontal movement of the tubular members in the T couplings. The limiter is added to prevent extreme upward movement of the lower tubular members. The upper tubular members control the movement of the floating facility in relationship to the shoreline when the level of the water is changing. Excessive movement of the upper tubular member is controlled by a spring cable attached between the upper shaft 35, FIG. 1, and the lower shaft 9, FIG. 1.

Although I have described only a typical preferred form and application of my invention, the invention should not be limited or restricted to specific details herein set forth, but I wish to reserve to myself any variations that may fall into the scope of the following claims:

I claim:

1. An adjustable mooring device suitable for attaching a floating facility to a fixed platform, the said device comprising a system of adjustable tubular members connected to each other by rotatable T couplings:

(a) a first pair of laterally spaced tubular members (1) the said first pair of tubular members being mounted in a first pair of laterally spaced T couplings, rotatably mounted on a first shaft, the said first shaft being fixably attached to a fixed surface at two positions, (2) the said first pair of laterally spaced tubular members extending from the said first pair of T couplings to a second pair of laterally spaced T couplings rotatably mounted on a second shaft, (b) a second pair of laterally spaced tubular members extending from the said second pair of T couplings to a third pair of laterally spaced T couplings mounted on a third shaft, (c) a fourth pair of laterally spaced T couplings mounted on the said third shaft, (d) a third pair of laterally spaced tubular members extending in one direction from the said fourth pair of laterally spaced T couplings to a fifth pair of laterally spaced T couplings rotatably mounted on a fourth pair of laterally spaced T couplings to a fifth pair of laterally spaced T couplings rotatably mounted on a fourth shaft, the said third pair of laterally spaced tubular members extending in the opposite direction to a Y member, the said Y member being connected to means for securing the said floating facility, by the lower section of the said Y connection being supported at the water surface by a float; the said Y connection being connected by suitable means to the said floating facility, (e) a fourth pair of laterally spaced tubular members extending from the said fifth pair of laterally spaced T couplings to a sixth pair of laterally spaced T couplings, the said sixth pair of laterally spaced T couplings being mounted on the said first shaft, and (f) a limiter positioned over the said second pair of T couplings.

2. The mooring device as claimed in claim 1 where a counter-weight is centrally mounted on the said second shaft.

3. The mooring device as claimed in claim 1 where two of the said mooring devices are connected to a single floating facility.

4. The mooring device as claimed in claim 1 where the said Y members are connected by swivel means to a floating facility.

5. The mooring device as claimed in claim 1 where a spring and cable in combination is suspended between said first shaft and said third shaft.

* * * * *